United States Patent [19]

Cox

[11] Patent Number: 5,009,426

[45] Date of Patent: Apr. 23, 1991

[54] GOLF CLUB GUIDE MEANS

[76] Inventor: Robert W. Cox, 33 Chapel Hill Road, Chapel Hill, Queensland 4069, Australia

[21] Appl. No.: 480,531

[22] Filed: Feb. 7, 1990

Related U.S. Application Data

[63] Continuation-in-part of Ser. No. 347,886, Apr. 25, 1989, abandoned.

[30] Foreign Application Priority Data

Oct. 27, 1986 [AU] Australia ..... PH8710
Oct. 27, 1987 [AU] Australia ..... PCT/AU87/00363

[51] Int. Cl.[5] ..... A63B 69/36
[52] U.S. Cl. ..... 273/186 A; 273/194 R
[58] Field of Search ..... 273/186 A, 194 R, 165, 273/183 B, 81 D, 183 D

[56] References Cited

U.S. PATENT DOCUMENTS

| | | | |
|---|---|---|---|
| 1,990,281 | 2/1935 | Grelle | 273/186 A |
| 3,227,455 | 1/1966 | Hulsman | 273/165 |
| 3,918,721 | 11/1975 | Trask | 273/183 B |
| 4,023,812 | 5/1977 | Lorang | 273/194 R |
| 4,145,054 | 3/1979 | Stewart | 273/194 R |

*Primary Examiner*—George J. Marlo
*Attorney, Agent, or Firm*—Poms, Smith, Lande & Rose

[57] ABSTRACT

A golf club guide which attaches to a club shaft and provides an abutment which continuously engages the user's trailing forearm during both the backswing and follow-through positions, in order to maintain operative alignment between the club and the user's trailing arm as the club is swung through said positions.

13 Claims, 6 Drawing Sheets

GOLF CLUB GUIDE MEANS

This application is a continuation-in-part of Ser. No. 07,347,886, filed Apr. 25, 1989, now abandoned.

This invention relates to a golf club guide means.

In the past many devices have been provided for practicing golf strokes. The general aim of such devices is to enable a player to perfect the stance for addressing the ball and the swing. It is generally considered that the correct swing is performed in a single plane, called the "swing plane" and to date all sorts of rules for stance and body alignment have been formulated to enable a golfer to achieve the correct swing. For example those players who have become successful golfers have attempted to define arbitrary rules by reference to their own body positions and feelings.

During a game of golf many different strokes are performed. These may be performed under less than ideal conditions and of course the greater the number of variables in a player's swing, the less the chance a player has of performing consistently. It follows that if a constant swing can be mastered and used for all strokes, the number of variables will be greatly reduced and more consistent results can be obtained. Once a constant swing has been mastered, different strokes may be played according to the situation by selection of ball position relative to the player, i.e., to be hit upon the downstroke, at the bottom of the swing or on the upstroke, the correct club and the correct angle of the striking face of the club relative to the swing plane. This angle may be selectively varied to produce inswingers or outswingers.

Teaching aids are available for teaching players a correct swing such as the device illustrated in my International patent application No. PCT/AU 84/00138. While such aids are effective, teaching the correct swing, one problem which recurs is the lack of correct pivot control of the wrist so as to maintain the club in a predetermined relationship relative to the players trailing forearm. In the backswing position this results in the head of the club either "laying off" or "crossing the line", i.e. moving to either side of the desired swing plane. Players with these faults have to take corrective action on the down stroke prior to the club correctly striking the ball. This invariably results in inconsistent play. Such swing inaccuracies are also apparent in many players who have not received swing training.

Accordingly, there exists a need for a device which can be associated with a golf club whereby a player may train either on the course or at a practice venue and monitor the correct wrist action.

Earlier attempts have been made to provide such monitoring as is disclosed in Trask U.S. Pat. No. 3,918,721 and in Stewart U.S. Pat. No. 4,145,054. The guide means disclosed in both prior art documents rely on contact of the guide with the arm of the user to signal a fault in the swinging action. Both devices are capable of providing only coarse or gross control, because a fault in technique will begin and become exaggerated before the guide means finally comes into contact with the arm. Thus significant faults may occur which are not detected by the apparatus. Furthermore, the prior art guides are so shaped that there can be no contact with the user's forearm during the critical portion of the swing approaching and at and near the point of contact. Thus errors at this position can go undetected.

It is desirable that at the point of impact, the angular relationship between the trailing forearm and the club be substantially constant every time a stroke is played. Furthermore during each individual stroke it is desirable to maintain a given substantially constant angular relationship between the forearm and the club except for the latter part of the stroke leading to impact. The guide means of the prior art have not met these needs.

The present invention aims to alleviate the above-mentioned disadvantages and to provide guide means which will enable a user to practice wrist control during stroke playing. Other objects and advantages of this invention will hereinafter become apparent.

With the foregoing and other objects in view, this invention in one aspect resides broadly in guide means cooperable with the shaft of a golf club to provide a forearm contact guide portion which may be maintained in contact with the user's trailing forearm throughout a golf stroke, said guide portion extending from a first position which when the guide means is attached to a golf club is spaced from the club shaft whereby said guide portion may contact the user's forearm when the club is held in a backswing position, to a second position which when the guide means is attached to a golf club extends towards and terminates adjacent the golf club shaft axis whereby said guide portion may contact a user's forearm when the club is held in the ball striking position.

Preferably the guide means includes a detachable mounting adapted for rigid connection with the shaft of a golf club. Alternatively, the guide means could be formed integrally with the shaft of a club or a club could be provided with suitable connection means to enable the guide means to be releasably attached thereto.

It is also preferred that the guide means is a substantially arcuate guide bar having an intermediate guide portion which may be operatively positioned with its axis substantially coincident with the wrist of the user's trailing arm. Such arrangement has the advantage that during the performance of a stroke the guide bar slides across substantially the same portion of the trailing forearm. Of course a bowed guide bar could be used if desired whereby in use the guide bar would slide along and across the user's arm during the performance of a stroke.

The detachable mounting may be in the form of a clamp adapted to be releasably secured to the shaft of the club at the top or bottom end of the hand grip. Alternatively the club's shaft may be provided with a fixed socket portion into which the guide bar may be releasably engaged. The guide bar may be mounted in such manner that it may be pivoted from its operative position to an inoperative position remote from the user's arm. The guide bar may also be provided with sighting means whereby it may be accurately positioned on the golf club relative to the club head and suitably so that its guide face is contained in a plane which extends parallel to a plane containing the lower forward edge of the striking face. Alternate mounting positions may be indicated to enable a user to adapt the device to their liking or to reposition it for different strokes.

It is also preferred that the guide bar be provided with stop means which engages the upper face of the user's trailing forearm to limit pivotal movement of the club shaft relative to the user's trailing forearm. Preferably the stop means is adjustable and may be set to limit relative pivotal movement between the forearm and the club shaft to approximately ninety degrees. This relative attitude is suitably maintained in the backswing position and during the initial portion of the downswing.

Of course if desired, the guide means may be formed integrally with the club shaft and for this purpose it may be in the form of an upper extension of the club shaft. However if desired the upper extension of the club shaft may be adapted to engage co-axially and releasably with the upper end of the club shaft. Accordingly, in a further aspect, this invention resides in a golf club provided with a shaft having connection means for operatively supporting detachable guide means or including integral guide means.

In order that this invention may be more readily understood and put into practical effect, reference will now be made to the accompanying drawings which illustrate typical embodiments of this invention and wherein.

Figure 1:
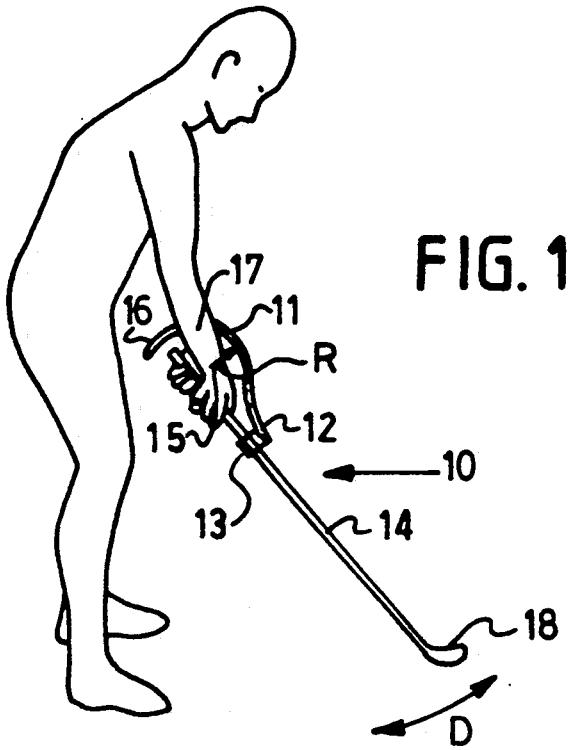
FIGS. 1 to 4 illustrate a series of swing positions with one form of guide means secured to the club shaft.
Figure 2:
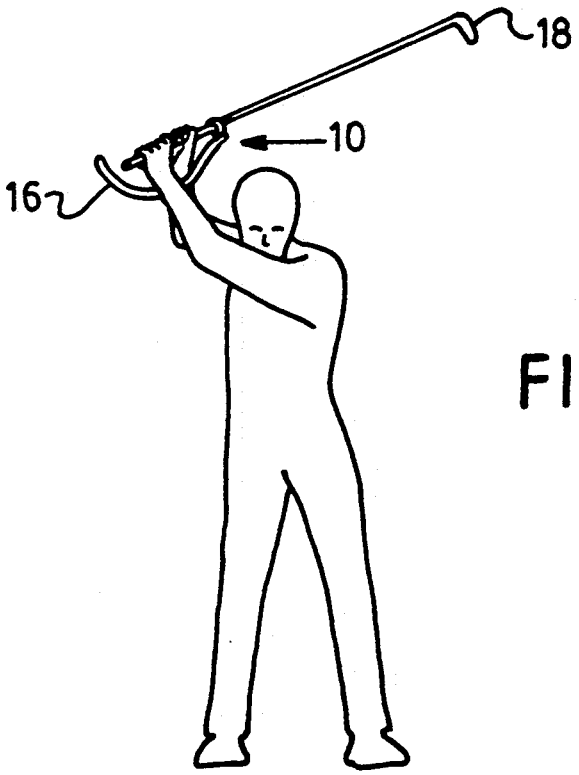
Figure 3:
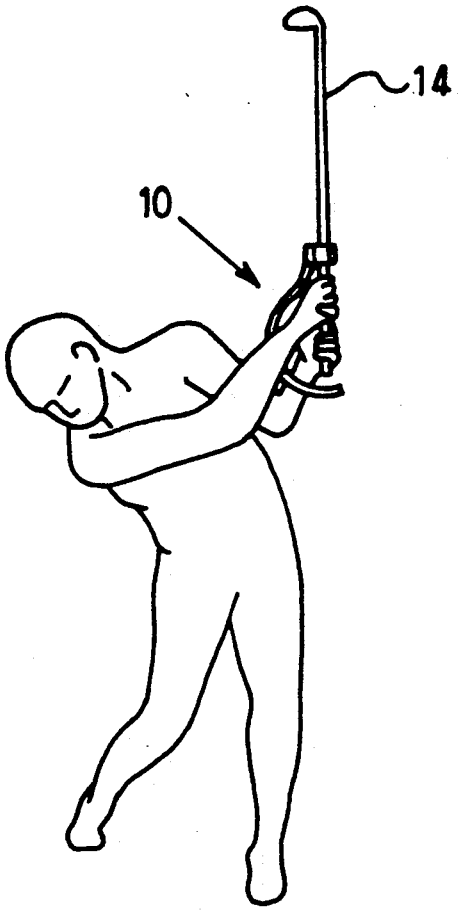
Figure 4:
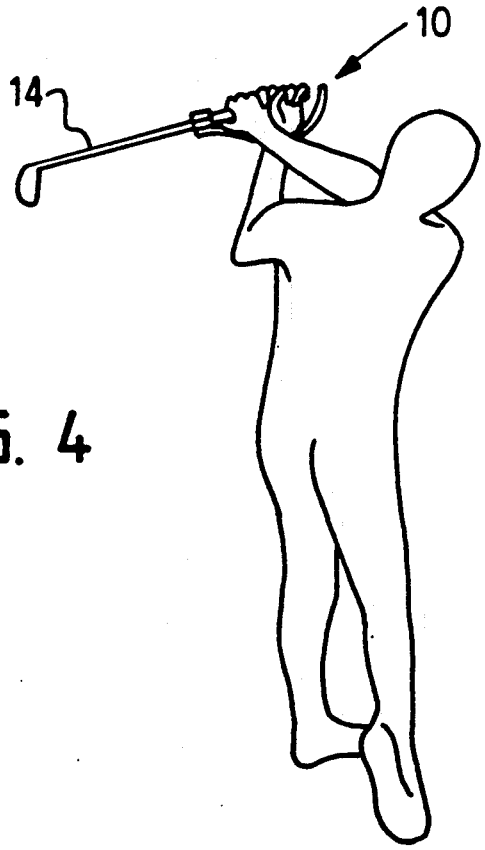

Referring to FIG. 1 it will be seen that the guide means 10 includes an arcuate guide bar 11 connected at its lower end 12 to a releasable clamp 13 adapted to be fixedly secured to the club shaft 14. The guide bar 11 is part circular and is adapted to be supported on the club shaft 14 so that its axis 15 is substantially coincident with the lower wrist as illustrated. The radius R of the arcuate portion 16 is such that it may engage the inner portion of the user's trailing forearm 17.

As illustrated, during a stroke, the wrist is substantially straight at the bottom of the stroke but is bent at the back swing and the follow through positions. The guide means 10 enables this pivoting of the wrist to be controlled by maintaining the portion 16 in contact with the trailing forearm 17.

As can be seen in FIG. 1 the guide means 10 may be engaged with the inside of the trailing forearm 17 so as to guide the club shaft 14 for pivotal movement in the direction indicated by the arrows D about the wrist 15 whereby the club shaft may be maintained in a fixed planar relationship with the golfer's forearm 17. This is particularly important in the backswing position, since uncontrolled pivoting of the wrist will move the club head 18 out of the desired swing plane. This undesirable movement of the club head 18 is generally known as the faults "laying off" or "crossing the line". When the club head is held in either of these incorrect positions the player must correct the pivotal attitude of the club during the downstroke so that the ball is struck by the head 18 with the latter in the correct striking position, which is fixed in relation to the trailing forearm 17.

In use, a player may attach the guide means 10 to the shaft 14 and adjust it so that the plane containing the guide bar 11 is substantially parallel to a further plane which is parallel to the club shaft 14. The player may then practice strokes while maintaining the guide bar 11 engaged with the inner portion of the trailing forearm 17 so as to maintain the club shaft 14 and head 18 in a desired swing plane.

During practice the arcuate bar portion 16 will slide across the forearm 17 as the player swings from the back swing position through the stroke and follow through positions. By utilizing the device in this manner the player will be trained to maintain correct pivotal movement of their wrist. Incorrect movement of the wrist will be indicated by separation of the arcuate portion 16 from the forearm or by increased pressure applied by the bar 11 to the forearm 17.

The arcuate bar portion 16 is rigidly affixed to the releasable clamp 13 which may be provided with a wing nut operated clamp to enable the bar 11 to be rigidly but releasably secured to the shaft 14. For this purpose the inside face of the clamp may be provided with a friction material to prevent rotation of the clamp about the shaft 14.

Figure 5:
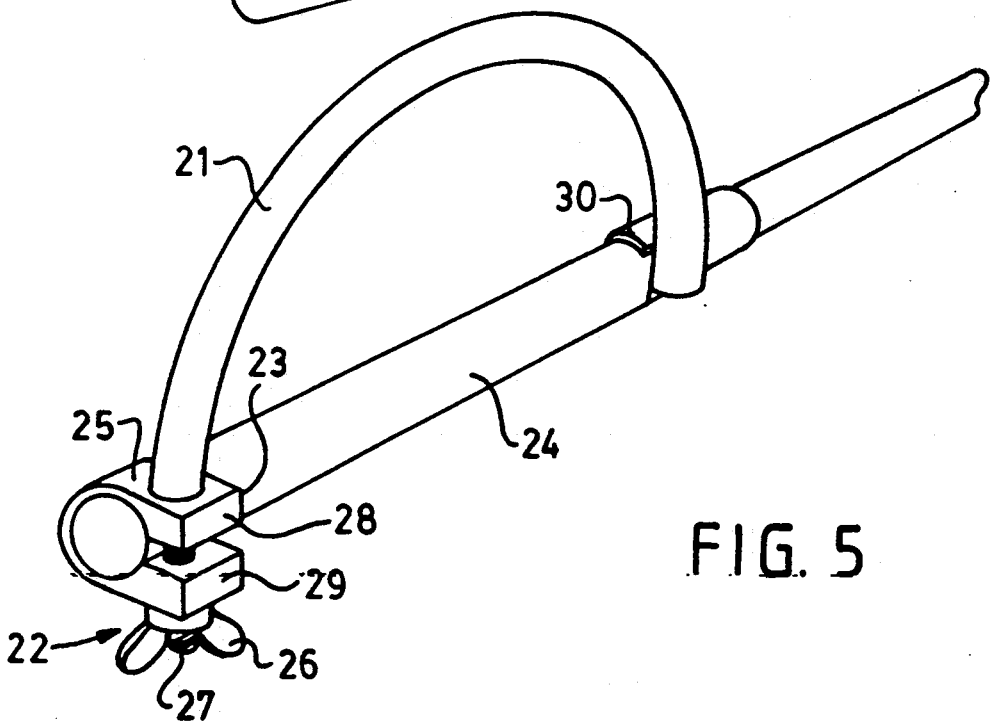
FIG. 5 illustrates a further embodiment of the invention.

The guide assembly 20 illustrated in FIG. 5 includes a guide bar 21 curved in a substantially semi-circular configuration. The guide bar 21 is provided with a releasable clamp assembly 22 at one and whereby it may be rigidly secured to the top end 23 of the club handle 24. The clamp assembly 22 includes a split mounting ring 25 integral with the guide bar 21 and a wing nut 26 which may be tightened along the stud 27 to draw the opposed parts 28 and 29 of the split mounting ring 25 tightly about the handle 24. The wing nut 26 may be released to permit the guide means 20 to be released from the handle 24.

The lower end of the guide bar 21 is provided with a retaining clip 30 whereby it may be clipped about the lower end of the handle 24 so as to stabilize the bar 21. As in the earlier embodiment, the accurate bar 21 is adapted to be positioned with its axis substantially coincident with the lower wrist of a golfer.

Figure 6:
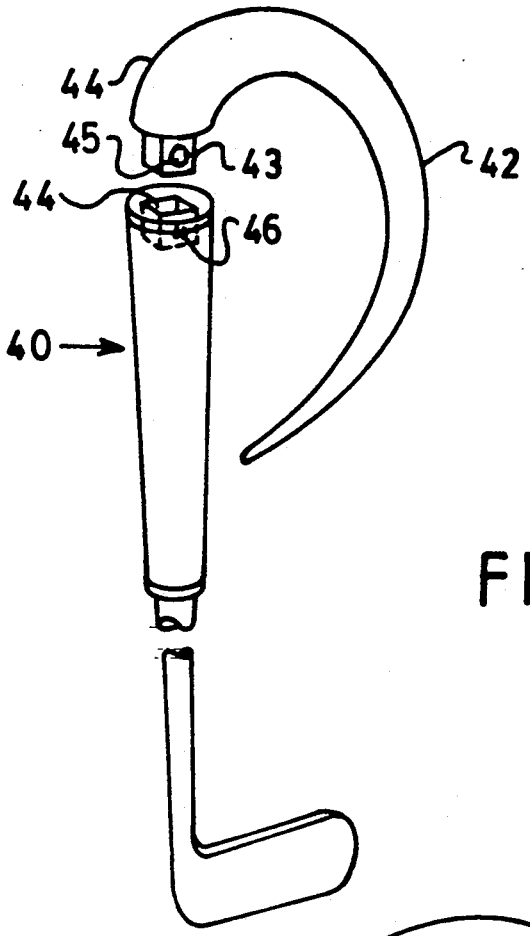
FIG. 6 illustrates a golf club assembly according to another embodiment of this invention.

FIG. 6 illustrates a golf club assembly 40 having a captive square sectioned mounting socket 41 for detachably receiving a tapered arcuate guide bar 42 provided with a square mounting spigot 43 at its upper end 44. The spigot 43 is provided with a locating ball 45 which is spring urged to an extended position to engage in a recess 46 arranged in one face of the socket 41 so as to retain the guide bar 42 in position while enabling it to be easily removed from the club shaft 47 when not required.

Figure 7:
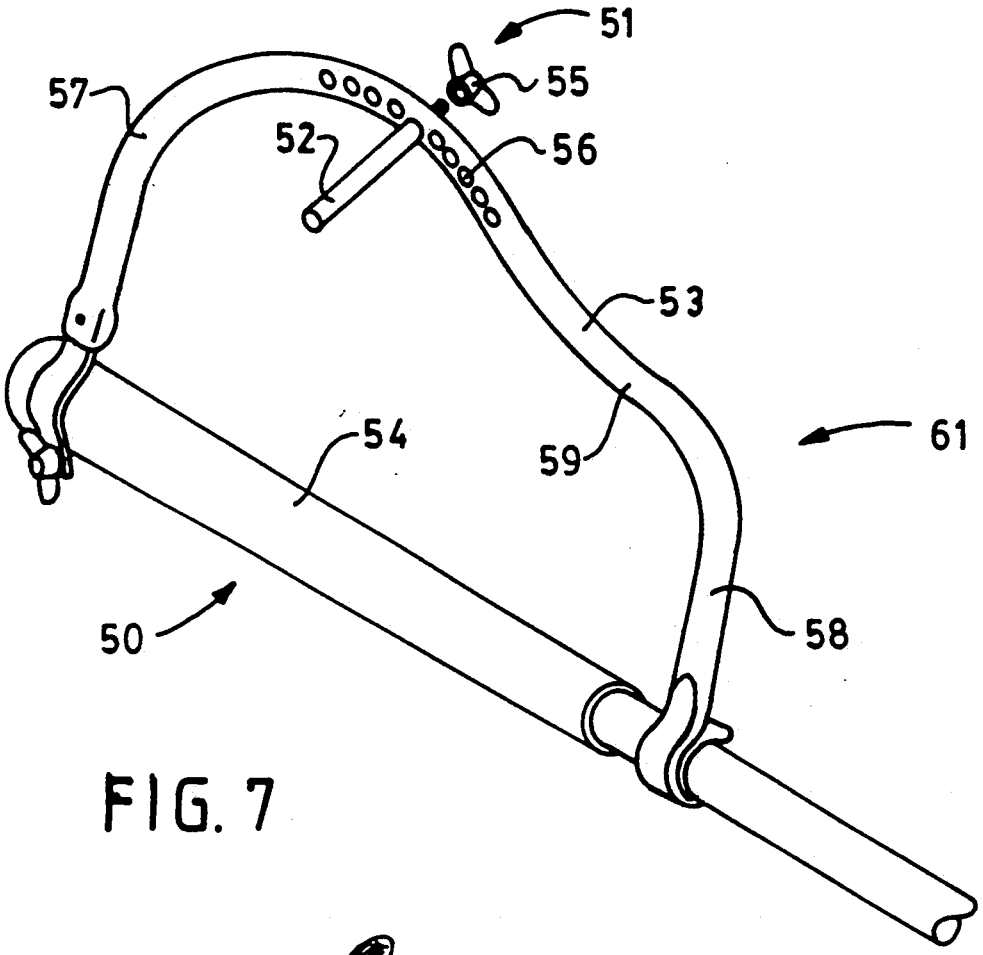
FIG. 7 illustrates yet another embodiment of the invention.

FIG. 7 illustrates a golf club guide assembly 50 incorporating a stop bar assembly 51 which will maintain the trailing forearm in a substantially correct angular relationship with the club during the backswing and the initial portion of the downswing. The stop bar assembly 51 consists of a stop bar 52 attached to the guide bar 53 and disposed substantially perpendicular to the plane containing the guide bar 53 and the club shaft 54. The stop bar 52 is removably bolted to the guide bar 53 through a selected one of a series of apertures 56 formed along the guide bar 53. The bolted connection is formed with a wing nut 55 mounted on the bolt which extends axially from the stop bar 52 to project through any of the apertures 56.

Figure 8:
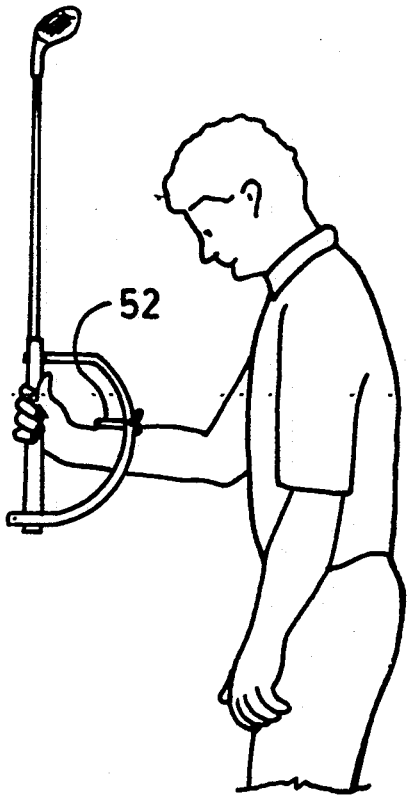
FIGS. 8 to 10 illustrate use of the embodiment of FIG. 7.
Figure 9A:
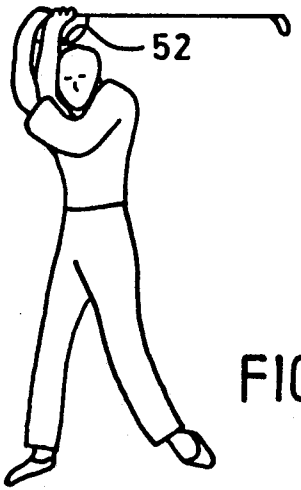
Figure 9B:
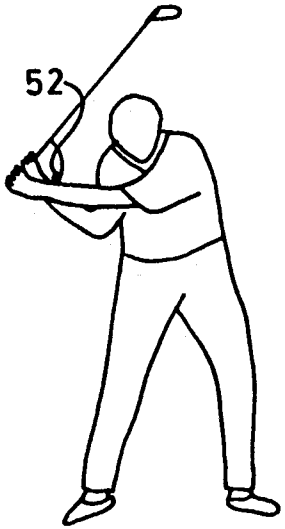
Figure 9C:
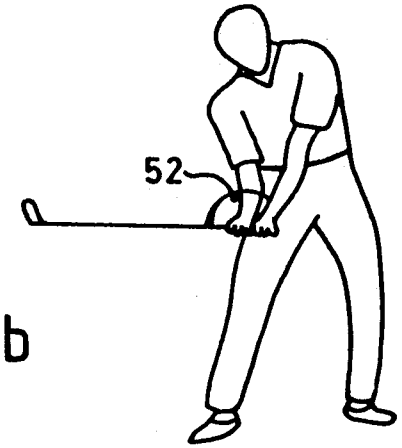
Figure 9D:
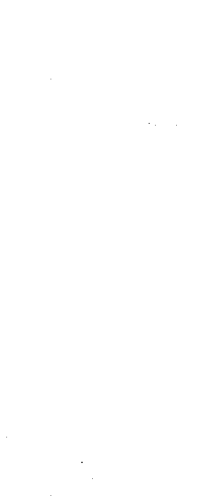
Figure 9E:
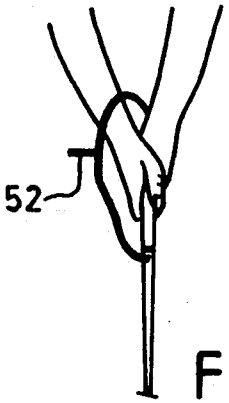
Figure 9F:
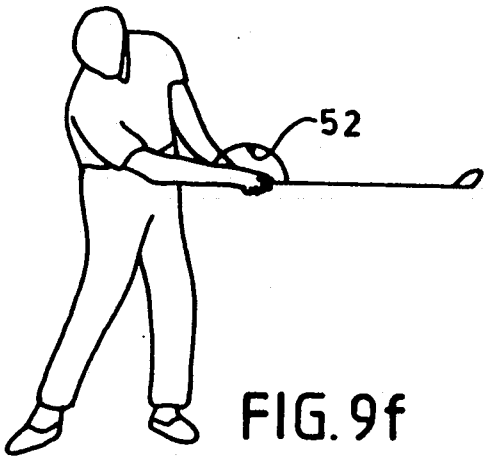

This arrangement enables individual players to set the stop bar 52 at a position suiting their individual physical proportions so that in use the correct angular relationship will be maintained as illustrated in FIG. 8 when the stop bar 52 engages the upper surface of the user's trailing forearm.

As may be seen in FIGS. 9*a* to 9*f*, in use the stop bar 52 is maintained in contact with the upper surface of the user's trailing forearm during the backswing-downswing phase of the stroke (FIGS. 9*a* and 9*b*) and is allowed to move away from the forearm, while still maintaining the guide bar 53 in contact with the inside of the trailing forearm, at the commencement of the hitting-through phase of the stroke (FIG. 9*c*), that is at the stage when the club shaft 54 is substantially parallel to the ground. This is considered desirable as maintenance of the fixed relationship between the club shaft and the trailing forearm during the initial downswing permits the user to accelerate the club head by pivotal wrist movement as the club head approaches the ball.

Figure 10:
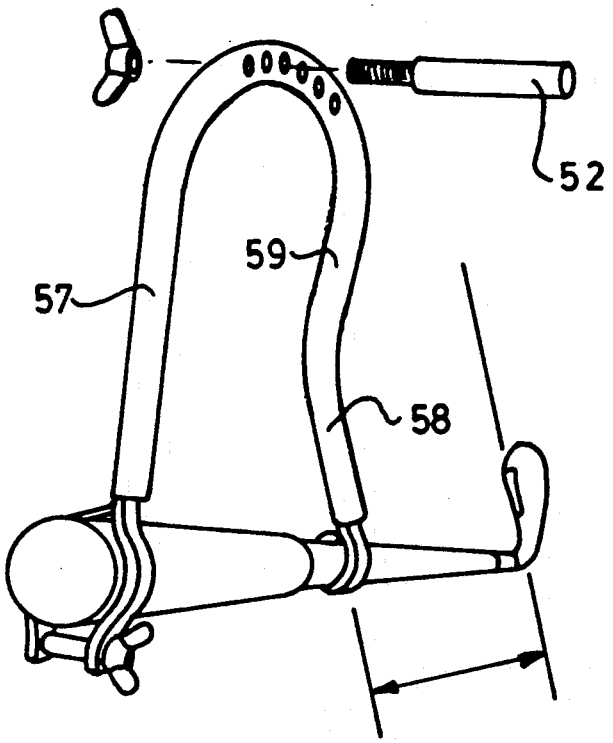

The golf club guide assembly 50 illustrated in FIG. 7 also incorporates aligning means 61 whereby the guide bar may be fixed to the club in the correct angular relationship thereto. The guide bar 53 consists of a first portion 57 adapted to slide against a user's forearm, and a second portion 58 adapted to be aligned with the lower forward edge 60 of the striking face of the club as illustrated in FIG. 10. The guide assembly is affixed to the club in the alignment shown in FIG. 10. The first and second portions 57 and 58 are joined by an intermediate portion 59 which is kinked relative to the first and second portions. The intermediate portion 59 provides an offset between the first and second portions such that a club, with a guide bar affixed as shown in FIG, 10, will be correctly gripped when the first portion abuts the user's trailing forearm.

The golf club guide assembly illustrated in FIGS. 5, 7 and 10 is shown to be off-set from the axis of the club shaft. This arrangement serves to prevent the guide interfering with the hand when gripping the top most portion of the handle of the club. The illustrated guide assemblies are also adapted for the use of a right-handed player. As will be readily appreciated, the off-setting of the assembly to the left-hand side of the club and the corresponding reversal of the stop bar to the left of the guide bar will provide an assembly suitable for use by a left-handed player.

It will be seen that this invention relies on constant contact between the guide means and the trailing arm of the user to indicate that the technique is correct, and relies on cessation of that contact to provide an instant indication that the technique has begun to be faulty. Consequently, and contrary to the teaching of prior art devices, the guide means of this invention provides an immediate indication that a user's swing action commences to be incorrect, rather than as with the prior art devices, an indication only when the fault has become excessive. Furthermore, the guide means of this invention acts as a restraining device to positively maintain the correct club alignment relative to the users trailing forearm. Moreover, the guide means of this invention differs from the prior art in that it may be maintained in contact with the users trailing forearm for the full swing of a golf stroke and in particular during contact with the ball when the trailing forearm extends substantially parallel to and adjacent the club shaft.

It will of course be realised that while the above has been given only by way of illustrative examples of the present invention, all such modifications and variations thereto, as would be apparent to persons skilled in the art, are deemed to fall within the broad scope and ambit of this invention as is defined in the appended claims.

I claim:

1. A golf club and guide bar assembly including a golf club and attached thereto a guide bar having mounting means at one end thereof rigidly and releasably attached to the shaft of said golf club, said guide bar having a forearm contact guide portion which slides over and is maintained in contact with the user's trailing forearm throughout a golf stroke and including contact at the backswing position and contact at the ball-striking position to provide an indication of the alignment of the golf club head relative to the user's trailing forearm, said forearm contact guide portion extending from a first position spaced from the golf club handle whereby the user's trailing forearm will contact the forearm contact guide portion at said first position when the golf club is held in the backswing position, to a second position adjacent the upper end of the golf club handle, and said forearm contact guide portion having a terminal end extending in a direction back toward said golf club handle, whereby the user's trailing forearm will contact the forearm contact guide portion at said second position when the golf club is held in the ball-striking position.

2. A guide bar assembly according to claim 1, wherein said mounting means includes clamping means adapted to clamp about the golf club shaft or handle.

3. A guide bar assembly according to claim 2, wherein said guide bar is provided with a spring clip at the end opposite said one end.

4. A guide bar assembly according to claim 3, wherein said mounting means is engageable with the outer end of the golf club handle.

5. A guide bar assembly according to claim 4, wherein said guide bar is substantially semicircular.

6. A guide bar assembly according to claim 5, wherein said guide bar lies substantially in a plane which when said bar is mounted on a golf club extends parallel to a plane containing the lower forward edge of the striking face of the golf club head and said guide bar.

7. A guide bar assembly according to claim 1, wherein said mounting means includes complementary female and male interconnecting members.

8. A guide bar assembly according to claim 1, and including forearm limiting means supported on said forearm contact guide position so as to extend away therefrom whereby said limiting means may engage the upper portion of a user's trailing forearm and limit the pivotal movement between said club and the user's trailing forearm.

9. A guide bar assembly according to claim 7, wherein said limiting means is mounted to said guide bar whereby said limiting means may be selectively positioned along said guide bar.

10. A guide bar assembly according to claim 9, wherein said guide bar is provided with a plurality of mountings therealong and wherein said limiting means may be selectively engaged with a selected one of said mountings.

11. A guide bar assembly according to claim 1, wherein said guide bar includes aligning means thereon extending from said first position to the end opposite said one end.

12. A guide bar assembly according to claim 11, wherein said aligning means includes a substantially linear portion.

13. A guide bar assembly according to claim 12, wherein said substantially linear portion is offset from said forearm contact guide portion.

* * * * *